United States Patent [19]

Liberati et al.

[11] Patent Number: 5,073,285

[45] Date of Patent: Dec. 17, 1991

[54] STABLY SUSPENDED ORGANIC PEROXY BLEACH IN A STRUCTURED AQUEOUS LIQUID

[75] Inventors: Patricia Liberati, Valley Cottage, N.Y.; Jack T. McCown, Cresskill, N.J.; Michael Aronson, West Nyack, N.Y.; Johannes C. van de Pas, Vlaardingen, Netherlands

[73] Assignee: Lever Brothers Company, Division of Conopco, Inc., New York, N.Y.

[21] Appl. No.: 563,451

[22] Filed: Aug. 6, 1990

Related U.S. Application Data

[63] Continuation of Ser. No. 364,946, Jun. 12, 1989.

[51] Int. Cl.[5] ..... C11D 7/35; C11D 7/56

[52] U.S. Cl. ..... 252/94; 252/100; 252/103; 252/142; 252/143; 252/144; 252/145; 252/156; 252/174.23; 252/174.24; 252/DIG. 14

[58] Field of Search ..... 252/99, 174.24, DIG. 2, 252/DIG. 14, 99, 100, 103, 142, 143, 144, 145, 156

[56] References Cited

U.S. PATENT DOCUMENTS

| | | | |
|---|---|---|---|
| 4,079,015 | 3/1978 | Paucot | 252/99 |
| 4,556,504 | 12/1985 | Rek | 252/174.24 |
| 4,793,942 | 12/1988 | Lokkesmoe | 252/99 |
| 4,822,510 | 4/1989 | Madison et al. | 252/95 |
| 4,879,057 | 11/1989 | Dankowski | 252/99 |
| 4,881,940 | 11/1989 | Massaux | 252/99 |
| 4,891,147 | 1/1990 | Gray | 252/DIG. 14 |
| 4,900,469 | 2/1990 | Farr | 252/99 |

FOREIGN PATENT DOCUMENTS

| | | |
|---|---|---|
| 0160342 | 11/1985 | European Pat. Off. . |
| 0197635 | 10/1986 | European Pat. Off. . |
| 0244006 | 11/1987 | European Pat. Off. . |
| 1201958 | 6/1988 | European Pat. Off. . |

OTHER PUBLICATIONS

Derwent Abstract of French Patent 2,369,338, European Search Report.

*Primary Examiner*—Paul Lieberman
*Assistant Examiner*—Kevin D. McCarthy
*Attorney, Agent, or Firm*—James J. Farrell

[57] ABSTRACT

An aqueous based structured Heavy duty liquid detergent formulation is disclosed, which contains selected bleaches, surfactant combinations, borate polyol pH jump systems, and selected decoupling polymers.

2 Claims, No Drawings

STABLY SUSPENDED ORGANIC PEROXY BLEACH IN A STRUCTURED AQUEOUS LIQUID

This is a continuation application of Ser. No. 364,946, filed June 12, 1989, pending.

BACKGROUND OF THE INVENTION

1. Field of the Invention

This invention relates to a structured aqueous based heavy duty liquid detergent formulation containing a suspended bleach along with selected stability enhancers.

Liquid detergent products have become a large segment of the U.S. detergent market. Their market share in the past several years has more than doubled. Currently marketed liquid detergents contain built-in softening in the wash as well as enzymes for added stain removal. No completely formulated liquid detergents however, contain a completely satisfactory bleach.

Liquid bleach adjuncts which are to be added separately to the wash, containing hypochlorite or hydrogen peroxide are established, successful products. A low pH surfactant-structured liquid containing 1,12 diperoxydodecanedioic acid (DPDA), has been patented by Humphreys et al. in U.S. Pat. No. 4,642,198. A structured aqueous system has been employed in this bleach adjunct out due to the low pH and low amount of surfactant usually employed, the adjunct product cannot be used alone to accomplish washing.

The high concentrations of surfactants which must be included in a fully formulated liquid detergent to clean during the wash generally make it difficult to prepare an appropriately structured liquid. Structuring, however, is necessary to suspend the particulate bleach and, thus, minimize settling and other types of instability. Structured liquids are well known in the art and are described more fully below. Further, the large amount of surfactant required usually increases the viscosity of structured liquids to unacceptable levels. The viscosity, thus, must be decreased to a commercially acceptable level while still retaining the suspending characteristics of the structured liquid.

An additional difficulty is that the suspended bleach particles must not be too soluble in the product or the bleach may react with included organic materials. It is, thus, desirable to further stabilize the bleach by decreasing the pH of the concentrated composition to decrease the solubility of the bleach particles. A low pH, however, is not optimal for washing and, thus, it must be capable of increasing substantially on dilution when the product is used so that normal alkaline wash pH's can prevail.

It was, thus, desireable to formulate an aqueous based heavy duty detergent which contains relatively stable bleach and high levels of surfactant, yet still retains the suspending properties of a structured liquid while incorporating acceptable viscosity characteristics.

DESCRIPTION OF THE ART

One of the early patents is U.S. Pat. No. 3,996,152 (Edwards et al.) disclosing the suspension of diperoxyacids by non-starch thickening agents such as Carbopol 940 in an aqueous media at low pH. Suitable actives were diperazelaic, diperbrassylic, dipersebacic and diperisophthalic acids. U.S. Pat. No. 4,017,412 (Bradley) reports similar systems except that starch based thickening agents were employed from later investigations it became evident that the thickener types mentioned in the foregoing patents formed gel-like matrices which exhibited instability upon storage at elevated temperatures. At high concentrations they cause difficulties with high viscosity.

U.S. Pat. No. 4,642,198 (Humphreys et al.) hereby incorporated by reference herein, lists a variety of water-insoluble organic peroxy acids intended for suspension in an aqueous, low pH liquid. This patent disclosed the use of surfactants, both anionic and nonionic, as suspending agents for the peroxy acid particles. The preferred peroxy material was 1,12-diperoxydodecanedioic acid (DPDA).

This art has emphasized optimizing the suspending or thickening chemical components of the liquid bleach to improve physical stability.

EP 176,124 to de Jong and Torenbeck discloses a pourable bleach composition containing peroxycarboxylic acid in an aqueous suspension with 0.5 to 15% alkylbenzene sulfonic acid and low levels of sulfate salt.

Neither of the above patents discloses the use of a system which will allow the compositions to be used as effective heavy duty liquid detergents in the main wash. Both compositions must be used with a buffered adjunct (powder or liquid) to ensure the neutral to alkaline pH necessary for general detergency. The decline in detergency with reduced pH is well known in the art and is discussed in Cockrell, U.S. Pat. No. 4,259,201. deJong avoids high surfactant concentrations. Such compositions are said to be excessively thick and difficult to pour. Humphreys' claims surfactant concentrations from 2–50%; however, compositions in excess of about 15% may exhibit excessive thickness and Humphrey's pH is too low for commercially acceptable detergency.

There have been many different approaches to the problem of producing an aqueous based heavy duty liquid detergent containing a bleach; however, none of these approaches have been completely satisfactory. In many cases stability has been enhanced at the expense of acceptable Viscosity or a low pH has been employed to improve bleach stability by sacrificing alkaline wash pH's.

Accordingly, it is an object of the present invention to provide a fully formulated aqueous based heavy duty liquid detergent composition containing a suspended peroxy bleach. The composition exhibits good stability, acceptable viscosity and good bleaching and cleaning characteristics while substantially eliminating or minimizing many of the problems of the art.

Other objects and advantages will appear as the description proceeds.

SUMMARY OF THE INVENTION

The attainment of the above objects is made possible by this invention which includes an aqueous based liquid cleaning composition containing generally the following components:

(1) 1 to 40% by weight of a solid, particulate, substantially water-insoluble organic peroxy acid;

(2) about 10 to 50% by weight of a surfactant;

(3) about 1 to 40% by weight of a pH adjusting "jump" system including:

(a) a borate;

(b) a polyol, and having a polyol to borate ratio of 1:1 to 10:1; and (4) about 0.1 to 5% of a stability enhancing polymer which ia a copolymer of a hydrophilic and a hydrophobic monomer, the hydrophilic monomer selected from the group of the acid or salt derivatives of maleic anhydride, acrylic acid, methacrylic acid, as well as analogues where the carboxylate group is replaced by other anionic moieties such as sulfonate, sulfate phosphonate and the like as well as mixtures thereof, the hydrophobic monomer being either a hydrophilic monomer functionalized with a hydrophobic moiety selected from the group of fatty amides fatty esters, fatty alkoxylates, $C_{8-22}$ alkyls, fatty alkylaryls and mixtures thereof or a pendant alkyl group such as that formed by reaction of a $C_{8-22}$ $\alpha$ olefin.

(5) optional viscosity modifiers.

(6) standard detergent ingredients such as fluorescent whiteners, dyes, perfumes, enzymes, and the like.

DETAILED DESCRIPTION OF THE INVENTION

Aqueous structured heavy duty liquids containing a color-safe peroxyacid bleach have been developed. The liquids generally contain 10–50% surfactant, 1–40% of a "pH jump" system for providing a suitable pH environment in both the concentrated product and on dilution in the wash, 1–40% of an insoluble organic peroxyacid bleach, 0.10–2.0% sequestering agent to minimize transition-metal catalyzed bleach decomposition, 0–10% viscosity reducing agents such as excess inorganic salts, polyacrylates, and polyethylene glycols; and 0.10–2.0% or more of a "physical stability enhancing agent" or "decoupling" agent or "deflocculating" agent which increases the robustness of an otherwise physically metastable system. Additional ingredients can include builders, fluorescer, enzymes, perfume, antiredeposition aids, dye and the like.

BLEACHES

Peroxyacids usable in this invention are solid and substantially water insoluble compounds. One of the peroxyacids utilized has been 1,12 diperoxydodecanedioic acid (DPDA). More preferred peracids include 4,4'-sulfonylbisperoxybenzoic acid (SBPB, ex. Monsanto) and 1,14 diperoxytetradecanoic acid (DPTA). In general, the organic peroxyacids can contain one or two peroxy groups and can be either aliphatic or aromatic. Examples include alkylperoxy acids, alkenylperoxy acids and arylperoxy acids such as peroxybenzoic acid; aliphatic monoperoxyacids such as peroxylauric and peroxystearic acids; diperoxy acids including alkyldiperoxy acids, alkenyldiperoxy acids and aryldiperoxy acids such as 1,9-diperoxyazelaic acids, diperoxybrassylic acid, diperoxysebacic acid and diperoxyisophthalic acid.

Alternative bleaching agents also include phthaloyl amino-peroxocaproic acids "PAP", a new biodegradable, safe, high-melting peracid molecule available from Hoechst.

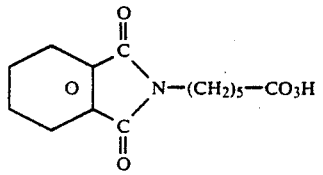

This peracid is believed to be soluble only in an alkaline - pH range.

The bleaching compounds will be present in an effective amount and will generally be a solid, particulate, substantially water-insoluble organic peroxy acid stably suspended in the composition. The compositions will have an acid pH in the range of from 1 to 6.5, preferably from 2 to 5.

The particle size of the peroxy acid used in the present invention is not crucial and can be from about I to 2000 microns although a small particle size is favoured for laundering application.

The composition of the invention may contain from about 1 to 40% by weight of the peroxy acid, preferably from 1 to about 10 by weight.

DEFLOCCULATING POLYMERS

The second essential component is a stability enhancing polymer which is a copolymer of hydrophilic and hydrophobic monomers. Suitable polymers are obtained by copolymerizing maleic anhydride, acrylic or methacrylic acid or other hydrophilic monomers such as ethylene or styrene sulfonates and the like with similar monomers that have been functionalized with hydrophobic groups. These include the amides, esters, ethers of fatty alcohol or fatty alcohol exthoxylates.

In addition to the fatty alcohols and ethoxylates, other hydrophobic groups such as olefins or alkylaryl radicals may be used. What is essential is that the copolymer have acceptable oxidation stability and that the copolymer have hydrophobic groups that interact with the lamellar droplets and hydrophilic groups of the structured liquid to prevent flocculation of these droplets and thereby prevent physical instability and product separation. In practice, a copolymer of acrylic acid and lauryl methacrylate (M.W. 3800) has been found to be effective at levels of 0.5 to 1%.

These materials are more fully described in a companion case to Montague and Van de Pas Serial Number filed concurrently herewith and incorporated herein by reference.

In addition to the compounds mentioned above, and as more fully set out in the Montague et al. application, the compositions according to the invention may contain one, or a mixture of deflocculating or decoupling polymer types. The term 'polymer types' is used because, in practice, nearly all polymer samples will have a spectrum of structures and molecular weights and often impurities. Thus, any structure of deflocculation polymers described in this specification refers to polymers which are believed to be effective for deflocculation purposes as defined above. In practice, these effective polymers may constitute only part of the polymer sample, provided that the amount of deflocculation polymer in total is sufficient to effect the desired deflocculation. Furthermore, any structure described herein for an individual polymer type refers to the structure of the predominating deflocculating polymer species and the molecular weight specified is the weight average molecular weight of the deflocculation polymers in the polymer mixture.

The hydrophilic backbone of the polymer generally is a linear, branched or lightly crosslinked molecular composition containing one or more types of relatively hydrophilic monomer units. Preferably the hydrophilic monomers are sufficiently water soluble to form at least a 1% by weight solution when dissolved in water. The only limitations to the structure of the hydrophilic backbone are that the polymer must be suitable for incorporation in an active-structured aqueous liquid detergent composition and that a polymer corresponding to the hydrophilic backbone made from the backbone monomeric constituents is relatively soluble in water. The solubility in water at ambient temperature and at a pH of 3.0 to 12.5 is preferably more than 1 g/l, more preferably more than 5 g/l, and most preferred more than 10 g/l.

Preferably the hydrophilic backbone is predominantly linear; more preferably the main chain of the backbone constitutes at least 50% by weight, preferably more than 75%, most preferred more than 90% by weight of the backbone.

The hydrophilic backbone is composed of monomer units, which can be selected from a variety of units available for the preparation of polymers. The polymers can be linked by any possible chemical link, although the following types of linkages are preferred:

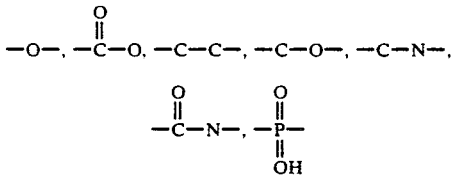

Examples of types of monomer units are:

(i) Unsaturated $C_{1-6}$ acids, ethers, alcohols, aldehydes, ketones, or esters. Preferably these monomer units are mono-unsaturated. Examples of suitable monomers are acrylic acid, methacrylic acid, maleic acid, crotonic acid, itaconic acid, aconitic acid, citraconic acid, vinylmethyl ether, vinyl sulphonate, vinyl alcohol obtained by the hydrolysis of vinyl acetate, acrolein, allyl alcohol and vinyl acetic acid.

(ii) Cyclic units, either unsaturated or comprising other groups capable of forming inter-monomer linkages. In linking these monomers the ring-structure of the monomers may either be kept intact, or the ring structure may be disrupted to form the backbone structure. Examples of cyclic monomer units are sugar units, for instance, saccharides and glucosides; alkoxy units such as ethylene oxide and hydroxy propylene oxide; and maleic anhydride.

(iii) Other units, for example, glycerol or other saturated polyalcohols.

Each of the above mentioned monomer units may be substituted with groups such as amino, amine, amide, sulphonate, sulphate, phosphonate, phosphate, hydroxy, carboxyl and oxide groups.

The hydrophilic backbone of the polymer is preferably composed of one or two monomer types but three or more different monomer types in one hydrophilic backbone may be used. Examples of preferred hydrophilic backbones are: homopolymers of acrylic acid, copolymers of acrylic acid and maleic acid, poly 2-hydroxy ethyl acrylate, polysaccharides, cellulose ethers, polyglycerols, polyacrylamides, polyvinylalcohol/polyvinylether copolymers, poly sodium vinyl sulphonate, poly 2-sulphato ethyl methacrylate, polyacrylamido methyl propane sulphonate and copolymers of acrylic acid and tri methyl propane triacrylate.

Optionally the hydrophilic backbone may contain small amounts of reatively hydrophobic units, e.g. those derived from polymers having a solubility of less than 1 g/l in water, provided that the overall solubility of the hydrophilic polymer backbone still satisfies the solubility requirements as specified above. Examples of relatively water insoluble polymers are polyvinyl acetate, polymethyl methacrylate, polyethyl acrylate, polyethylene, polypropylene, polystryrene, polybutylene oxide, propylene oxide and polyhdroxy propyl acetate.

Preferably the hydrophobic side chains are part of a monomer unit which is incorporated in the polymer by copolymerising hydrophobic monomers and the hydrophilic monomers making up the backbone of the polymer The hydrophobic side chains for this use preferably include those which when isolated from their linkage are relatively water insoluble, i.e. preferably less than 1 g/l more preferred less than 0.5 g/l, most preferred less than 0.1 g/l of the hydrophobic monomers. will dissolve in water at ambient temperature and a pH of 3.0 to 12.5

Preferably the hydrophobic moieties are selected from siloxanes, saturated and unsaturated alkyl chains, e.g. having from 5 to 24 carbon atoms, preferably from 6 to 18, most preferred from 8 to 16 carbon atoms, and are optionally bonded to the hydrophilic backbone via an alkoxylene or polyalkoxylene linkage, for example, a polyethoxy, polypropoxy or butyloxy (or mixture of same) linkage having from 1 to 50 alkoxylene groups. Alternatively the hydrophobic side chain may be composed or relatively hydrophobic alkoxy groups, for example, butylene oxide and/or propylene oxide, in the absence of alkyl or aklenyl groups. In some forms, the side-chain(s) will essentially have the character of a nonionic surfactant.

In this context UK patent specifications GB 1 506 427 A and Gb 1 589 971 A disclose aqueous compositions including a carboxylate polymer partly esterified with nonionic surface active side-chains. The particular polymer described ( a partially esterified, neutralized copolymer of maleic anhydride with vinylmethyl ether, ethylene or stryrene, present at from 0.1 to 2% by weight of the total composition) is not completely satis factory.

Thus, one aspect of the present invention provides a structured liquid detergent composition having a dispersion of lamellar droplets in an aqueous continuous phase, and a deflocculating polymer having a hydrophilic backbone and at least one hydrophobic side-chain.

U.S. Pat. Nos. 3,235,505, 3,238,309, and 3,457,176 describe the use of polymers having relatively hydrophilic backbones and relatively hydrophobic side-chains as stabilizers for emulsions.

Preferably, the deflocculating polymer has a lower specific viscosity than those disclosed in GB 1 506 427 A and GB 1 589 971 A, i e a specific viscosity less than 0.1 measured as 1 g in 100 ml of methylethylketone at 25° C. Specific viscosity is a dimensionless viscosity-related property which is independent of shear rate and is well known in the art of polymer science.

Some polymers having a hydrophilic backbone and hydrophobic side-chains are known for thickening isotropic aqueous liquid detergents, for example, from European Patent Specification EP-A-244 006.

One preferred class of polymers for use in the compositions of the present invention comprises those of general formula (I)

(I)

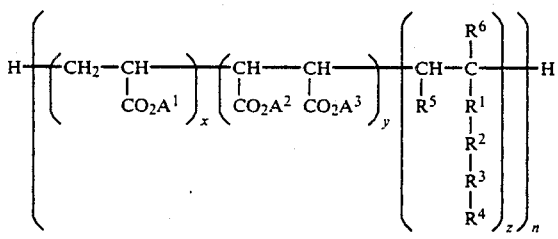

wherein:

z is 1; (x+y): z is from 4:1 to 1,000:1, preferably from 6:1 to 250:1; in which the monomer units may be in random order; y preferably being from 0 up to a maximum equal to the value of x; and n is at least 1;

$R^1$ represents —CO—O—, —O—, —O—CO—, —$CH_2$—, —CO—NH— or is absent;

$R^2$ represents from 1 to 50 independently selected alkyleneoxy groups preferably ethylene oxide or propylene oxide groups, or is absent, provided that when $R^3$ is absent and $R^4$ represents hydrogen or contains no more than 4 carbon atoms, then $R^2$ must contain an alkyleneoxy group with at least 3 carbon atoms;

$R^3$ represents a phenylene linkage, or is absent;

$R^4$ represents hydrogen or a $C_{1-24}$ alkyl or $C_{2-24}$ alkenyl group, with the provisions that a) when $R^1$ represents —O—CO—, $R^2$ and $R^3$ must be absent and $R^4$ must contain at least 5 carbon atoms;

b) when $R^2$ is absent, $R^4$ is not hydrogen and when $R^3$ is absent, then $R^4$ must contain at least 5 carbon atoms;

$R^5$ represents hydrogen or a group of formula —$COOA^4$;

$R^6$ represents hydrogen or $C_{1-4}$ alkyl; and $A^1$, $A^2$, $A^3$ and $A^4$ are independently selected from hydrogen, alkali metals, alkaline earth metals, ammonium and amine bases and $C_{1-4}$.

Another class of polymers for use in compositions of the present invention comprise those of formula (II)

(II)

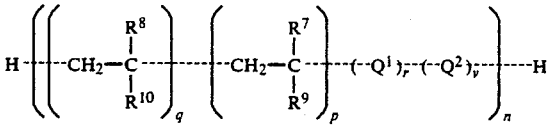

wherein:

$C^2$ is a molecular entity of formula (IIa):

(IIa)

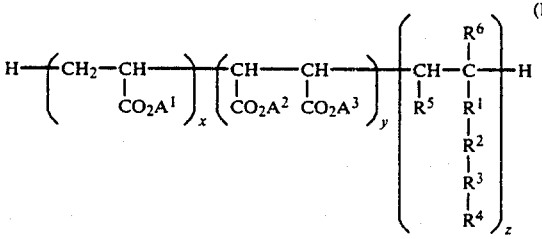

wherein z and $R^{1-6}$ are as defined for formula (I); $A^{1-4}$ are as defined for formula (I).

$Q^1$ is a multifunctional monomer, allowing the branching of the polymer, wherein the monomers of the polymer may be connected to $Q^1$ in any direction, in any order, therewith possibly resulting in a branched polymer. Preferably $Q^1$ is trimethyl propane triacrylate (TMPTA), methylene bisacrylamide or divinyl glycol.

n and z are as defined above; v is 1; and (x+y+p+q+r): z is from 4:1 to 1,000:1, preferably from 6:1 to 250:1; in which the monomer units may be in random order; and preferably either p and q are zero, or r is zero;

$R^7$ and $R^8$ represents —$CH_3$ or —H;

$R^9$ and $R^{10}$ represent substituent groups such as amino, amine, amide, sulphonate, sulphate, phosphonate, phosphate, hydroxy, carboxyl and oxide groups or $(C_2H_4O)_tH$, wherein t is from 1-50, and wherein the monomer units may be in random order, Preferably the substituted groups are selected from —$SO_3Na$, —CO—O—$C_2H_4$—$OSO_3Na$, —CO—O—N-H—$C(CH_3)_2$—$SO_3Na$, —CO—NH-$_2$,—O—CO—$CH_3$, —OH The above general formulas include those mixed copolymer forms wherein, within a particular polymer molecule where n is 2 or greater, $R^1$-$R^{12}$ differ between individual monomer units therein.

Although in the polymers of the above formulas and their salts, the only requirement is that n is at least 1, x (+y+p+q+r) is at least 4 and that they fulfill the definitions of the deflocculating effect hereinbefore described (stabilizing and/or viscosity lowering), it is helpful here to indicate some preferred molecular weights. This is preferable to indicating values of n. However, it must be realized that in practice there is no method of determining polymer molecular weights with 100% accuracy.

As already referred to above, only polymers of which the value of n is equal to or more than 1 are believed to be effective as deflocculating polymers. In practice, however, generally a mixture of polymers will be used. For the purpose of the present invention it is not necessary that the polymer mixtures as used have an average value of n which is equal or more than one; also polymer mixtures of lower average n value may be used, provided that an effective amount of the polymer molecules have one or more n-groups. Dependant on the type and amount of polymer used, the amount of effective polymer as calculated on the basis of the total polymer fraction may be relatively low, for example, samples having an average n-value of above 0.1 have been found to be effective as deflocculation polymers.

Gel permeation chromatography (GPC) is Widely used to measure the molecular weight distribution of water-soluble polymers. By this method, a calibration is constructed from polymer standards of known molecular weight and a sample of unknown molecular weight distribution is compared with this.

When the sample and standards are of the same chemical composition, the approximate true molecular weight of the sample can be calculated, but if such standards are not available, it is common practice to use some other well characterized standards as a reference. The molecular weight obtained by such means is not the absolute value, but is useful for comparative purposes. Sometimes it will be less than that resulting from a theoretical calculation for a dimer.

It is possible that when the same sample is measured, relative to different sets of standards, different molecular weights can be obtained. This is the case when using e.g. polyethylene glycol, polyacrylate and polystryrene sulphonate standards. For the compositions of the present invention exemplified hereinbelow, the molecular weight is specified by reference to the appropriate GPC standard.

For the polymers of formulae I and II and their salts, it is preferred to have a weight average molecular weight in the region of from 500 to 500,000, preferably from 750 to 100,000 most preferably from 1,000 to 30,000, especially from 2,000 to 10,000 when measured by GPC using polyacrylate standards. For the purposes of this definition, the molecular weights of the standards are measured by the absolute intrinsic viscosity method described by Noda, Tsoge and Nagasawa in Journal of Physical Chemistry, volume 74, (1970), pages 710–719.

In particular, the stability enhancing decoupling or deflocculating polymers are included in an amount of about 0.1 to 5% and are copolymers of a hydrophilic and a hydrophobic monomer. The hydrophilic monomer is preferably the acid or salt derivatives of maleic anhydride acrylic acid, methacrylic acid, and mixtures of these, the hydrophobic monomer is a hydrophilic monomer functionalized with a hydrophobic moiety which is preferably a fatty amide, fatty ester, fatty alkoxylate, C8-C22 alkyl, alkylaryl, and mixtures of these.

Some specific examples are as follows:

| Sample/No. | Composition (Molar) | Viscosity, cps. |
|---|---|---|
| 1 | 25:1 (100 AA)LMA | 3800 |
| 2 | 25:1 (95:5 AA:SVS)LMA | 520 |
| 3 | 25:1 (90:10 AA:SVS)LMA | 500 |
| 4 | 25:1 (95:5 AA:HEMA-S)LMA | 640 |
| 5 | 25:1 (90:10 AA:HEMA-S)LMA | 950 |
| 6 | 25:1 (95:% AA:AMPS)LMA | 9500 |
| 7 | 95:1 (90:10 AA:AMPS)LMA | 600 |

Abbreviations:
SVS - sodium vinyl sulfonate
HEMA-S - 2-sulphato ethyl methacrylate
AMPS - acrylamido methyl propane sulphonic acid
LMA - lauryl methacrylate
AA - acrylic acid

STRUCTURING SYSTEM—SURFACTANT

A third critical element of this invention is a surfactant structuring system. Structured surfactant combinations can include LAS/ethoxylated alcohol, LAS/lauryl ether sulfate (LES) LAS/LES/ethoxylated alcohol, amine oxide/SDS, cocoanut diethanolamide/LAS, and other combinations yielding lamellar phase liquids in the presence of pH jump components and other electrolytes at acidic pH's. Other anionic detergents such as secondary alkane sulfonates can be used in place of linear alkylbenzene sulfonate (LAS). These structured surfactant systems are necessary to suspend the insoluble peroxyacid crystals and thereby avoid undesirable settling on storage. Structuring and/or viscosity reducing salts can include sodium sulfate, sodium citrate, sodium phosphate and the like.

Aqueous surfactant structured liquids are capable of suspending solid particles without the need of other thickening agent and can be obtained by using a single surfactant or mixtures of surfactants in combination with an electrolyte. The liquid so structured contains lamellar droplets in a continuous aqueous phase.

The preparation of surfactant-based suspending liquids is known in the art and normally requires a nonionic and/or an anionic surfactant and an electrolyte, though other types of surfactant or surfactant mixtures, such as the cationics and zwitterionics, can also be used. Indeed, various surfactants or surfactant pairs or mixtures can be used in combination with several different electrolytes, but it should be appreciated that electrolytes which would easily be oxidized by peroxy acids, such as chlorides, bromides and iodides, and those which are not compatible with the desired acid pH range, e.g. carbonates and bicarbonates, should preferably be excluded from the peroxy acid suspending surfactant liquid compositions of the invention.

Examples of different surfactant/electrolyte combinations suitable for preparing the peroxy acid suspending surfactant structured liquids are:

(a) surfactants:
- (i) cocoanut diethanolamide/alkylbenzene sulphonate
- (ii) $C_9$-$C_{16}$ alcohol ethoxylate/alkylbenzene sulphonate;
- (iii) lauryl ethersulphate/alkylbenzene sulphonate;
- (iv) alcohol ether sulphate; in combination with:
- (v) secondaryl alkane sulfonates/alcohol ethoxylates
- (vi) alkyl ether sulfonates/alkylbenzene sulfonates-/alcohol ethoxylates (b) electrolytes:
- (i) sodium sulphate and/or
- (ii) sodium nitrate.

The surfactant structured liquids capable of suspending the peroxy acid include both the relatively low apparent viscosity, lamellar phase surfactant structured liquids and the higher apparent viscosity surfactant liquids with structuring resulting from other phase types, e.g. hexagonal phase, the viscosity of which may be in the range of from about 50 to 20,000 centipoises (0.05 to 20 Pascal seconds) measured at a shear rate of 21 second $^{-1}$ at 25° C.

Accordingly, aqueous liquid products having a viscosity in the above range are encompassed by the invention, though in most cases products having a viscosity of about 0.2 PaS, measured at $21s^{-1}$, particularly from 0.25 to 12 PaS, are preferred.

Although the primary objective of the present invention is to provide a stable peroxy acid suspending system in the form of a conveniently pourable thin liquid having a viscosity of up to about 5 PaS, more preferably up to about 3 PaS, the invention is not limited thereto. Also, thicker liquids can be prepared according to the invention having the solid water-insoluble organic peroxy acid in stable suspension. Hence, such thicker surfactant-based suspending liquid bleaching compositions are within the concept of the present invention.

As explained, the surfactants usable in the present invention can be anionic, nonionic, cationic, zwitterionic in nature or soap as well as mixtures of these. Preferred surfactants are anionics, nonionics and/or soap. Such usable surfactants can be any well-known detergent-active material.

The anionics comprise the well-known anionic surfactant of the alkyl aryl sulphonate type, the alkyl sulphate and alkyl ether sulphate and sulphonate types, the alkane and alkene sulphonate type etc. In these surfactants the alkyl radicals may contain from 9–20 carbon atoms. Numerous examples of such materials and other types of surfactants can be found in Schwartz, Perry, Vol. II, 1958, "Detergents and Surface Active Agents".

Specific examples of suitable anionic surfactants include sodium lauryl sulphate, potassium dodecyl sulphonate, sodium dodecyl benzene sulphonate, sodium salt of lauryl polyoxyethylene sulphate, lauryl polyethylene oxide sulfonate, dioctyl ester of sodium sulphosuccinic acid, sodium lauryl sulphonate.

The nonionics comprise ethylene oxide and/or propylene oxide condensation products with alcohols, alkylphenol, fatty acids, fatty acid amides. These products generally can contain from 5 to 30 ethylene oxide and/or propylene oxide groups. Fatty acid mono- and dialkylolamides, as well as tertiary amine oxides are also included in the terminology of nonionic detergent-active materials.

Specific examples of nonionic detergents include nonyl phenol polyoxyethylene ether, tridecyl alcohol polyoxyethylene ether, dodecyl mercaptan polyoxyethylene thioether, the lauric ester of polyethylene glycol, $C_{12}$–$C_{15}$ primary alcohol/7 ethylene oxides, the lauric ester of sorbitan polyoxyethylene ether, tertiary alkyl amine oxide and mixtures thereof.

Other examples of nonionic surfactants can be found in Schwartz, Perry, Vol. II, 1958, "Detergents and Surface Active Agents" and Schick, Vol. I, 1967, "Nonionic Surfactants".

The cationic detergents which can be used in the present invention include quaternary ammonium salts which contain at least one alkyl group having from 12 to 20 carbon atoms. Although the halide ions are the preferred anions, other suitable anions include acetate, phosphate, sulphate, nitrite, and the like.

Specific cationic detergents include distearyl dimethyl ammonium chloride, stearyl dimethyl benzyl ammonium chloride, stearyl trimethyl ammonium chloride, coco dimethyl benzyl ammonium chloride, dicoco dimethyl ammonium chloride, cetyl pyridinium chloride, cetyl trimethyl ammonium bromide, stearyl amine salts that are soluble in water such as stearyl amine acetate and stearyl amine hydrochloride, stearyl dimethyl amine hydrochloride, distearly amine hydrochloride, alkyl phenoxyethoxyethyl dimethyl ammonium chloride, decyl pyridinium bromide, pyridinium chloride derivative of the acetyl amino ethyl esters of lauric acid, lauryl trimethyl ammonium chloride, decyl amine acetate, lauryl dimethyl ethyl ammonium chloride, the lactic acid and citric acid and other acid salts of stearyl-1-amidoimidazoline with methyl chloride, benzyl chloride, chloroacetic acid and similar compounds, mixtures of the foregoing, and the like.

Zwitterionic detergents include alkyl-$\beta$-iminodipropionate, alkyl-$\beta$-aminopropionate, fatty imidazolines, betaines, and mixtures thereof.

Specific examples of such detergents are 1-coco-5-hydroxyethyl-5-carboxymethyl imidazoline, dodecyl-$\beta$-alanine, the inner salt of 2-trimethylamino lauric acid and N-dodecyl-N, N-dimethyl amino acetic acid.

The total surfactant amount in the liquid detergent composition of the invention may vary from 10 to 50% by weight, preferably from 10 to 35% by weight. In the case of suspending liquids comprising an anionic and a nonionic surfactant the ratio thereof may vary from about 10:1 to 1:10. The term anionic surfactant used in this context includes the alkali metal soaps of synthetic or natural long-chain fatty acids having normally from 12 to 20 carbon atoms in the chain. Although it is stressed that many types of surfactants can be used in the composition, those more resistant to oxidation are preferred.

The total level of structuring electrolyte(s) e.g. $Na_2SO_4$ present in the composition to provide structuring may vary from about 0.1 to about 10%, preferably from 0.1 to 5% by weight.

Since most commercial surfactants contain metal ion impurities (e.g. iron and copper) that can catalyze peroxy acid decomposition in the liquid bleaching composition of the invention, those surfactants are preferred which contain a minimal amount of these metal ion impurities. The peroxy acid instability results in fact from its limited, though finite, solubility in the suspending liquid base and it is this part of the dissolved peroxy acid which reacts with the dissolved metal ions. It has been found that certain metal ion complexing agents can remove metal ion contaminants from the composition of the invention and so retard the peroxy acid decomposition and markedly increase the lifetime of the composition.

A further improvement of the chemical stability of the peroxy acid can be achieved by applying some means of protection e.g. coating, to the solid peroxy acid particles from the surrounding medium. In that case other non-compatible electrolytes, such as halides, can also be used without the risk of being oxidised by the peroxy acid during storage.

Examples of useful metal ion complexing agents include dipicolinic acid, with or without a synergistic amount of a water-soluble phosphate salt; dipicolinic acid N-oxide; picolinic acid; ethylene diamine tetraacetic acid (EDTA) and its salts; various organic phosphonic acids or phosphonates (DEQUEST) such as ethylene diamine tetra-(methylene phosphonic acid) and diethylene triamine penta-(methylene phosphonic acid).

Other metal complexing agents known in the art may also be useful, the effectiveness of which may depend strongly on the pH of the final formulation. Generally, and for most purposes, levels of metal ion complexing agents in the range of from about 10–1000 ppm are already effective to remove the metal ion containments.

VISCOSITY MODIFIER

In the present invention, the preferred range of surfactant concentration is about 10% so as to provide sufficient actives in the main wash to function without the need for an adjunct containing actives. A critical element of the present invention is the use of polymers to control viscosity and avoid undue thickness.

High active level structured liquids tend to be viscous due to the large volume of lamellar phase which is induced by electrolytes (>6000 cp). In order to thin out these liquids so that they are acceptable for normal consumer use (<3000 cp), both excess electrolyte and materials such as polyacrylates and polyethylene glycols are used to reduce the water content of the lamellar phase, hence reducing phase volume and overall viscosity (osmotic compression). What is essential is that the polymer be sufficiently hydrophilic (less than 5% hydrophobic groups) so as not to interact with the lamellar droplets and be of sufficient molecular weight (>2000) so as not to penetrate into the water layers within the droplets.

PH ADJUSTING SYSTEM

Another critical component of the invention is a system to adjust pH or a pH "jump system". It is well known that organic peroxyacid bleaches are most stable at low pH (3–6), whereas they are most effective as bleaches in moderately alkaline pH (7–9) solution. Peroxyacids such as DPDA cannot be feasibly incorporated into a conventional alkaline heavy duty liquid because of chemical instability. To achieve the required pH regimes, a pH jump system has been employed in this invention to keep the pH of the product low for peracid stability yet allow it to become moderately high in the wash for bleaching and detergency efficacy. One such system is borax $10H_2O$/polyol. Borate ion and certain cis 1,2 polyols complex when concentrated to cause a reduction in pH. Upon dilution, the complex dissociates, liberating free borate to raise the pH. Examples of polyols which exhibit this complexing mechanism with borax include catechol, galactitol, fructose, sorbitol and pinacol. For economic reasons, sorbitol is the preferred polyol.

The ratio of sorbitol to borax decahydrate is critical to the invention. To achieve the desired concentrate pH of less than about 5, ratios greater than about 1:1 are required. The level of borax incorporated in the formulation also influences performance. Acid soils found in the wash can lower the pH of a poorly buffered system below 7 and result in inferior general detergency. Borax levels greater than about 2% are required to ensure sufficient buffering. Excessive amounts of borax (>10%) give good buffer properties; however, this leads to a concentrate pH that is higher than desired. In practice compositions of about 5% borax and 20% sorbitol yield the best compromise. Salts of calcium and magnesium have been found to enhance the pH jump effect by further lowering the pH of the concentrate(-See Table 9). Other di and trivalent cations may be used but Ca and Mg are preferred. Any anion may be used providing the Ca/Mg salt is sufficiently soluble. Chloride, although it could be used, is not preferred because of oxidation problem. Other types of pH jump systems are based on the principle of insoluble alkaline salts in the concentrate which dissolve on dilution to raise the solution pH. An example of a model system using $Na_2HPO_4.7H_2O/MgSO_4$ as the alkaline salt is given in the Table 10 below. A second example using sodium tripoly phosphate (STP), STP is given in Table 11. Other salts such as sodium carbonate, sodium bicarbonate, sodium silicates, sodium pyro and ortho phosphates may also be used. As the concentrate pH of these salt systems is greater than 5 it will introduce some instability. The Borax/polyol systems provide greater peracid stability and are preferred.

Boron compounds such as boric acid, boric oxide, borax or sodium ortho- or pyroborate may be employed.

OPTIONAL INGREDIENTS

In addition to the components discussed above, the heavy duty liquid detergent compositions of the invention may also contain certain optional ingredients in minor amounts. Typical examples of optional ingredients are suds-controlling agents, fluorescers, perfumes, colouring agents, abrasives, hydrotropes sequestering agents, enzymes, and the like in varying amounts. However, any such optional ingredient may be incorporated provided that its presence in the composition does not significantly reduce the chemical and physical stability of the peroxy acid in the suspending system.

The compositions of the invention, as opposed to thickened gel-like compositions of the art, are much safer in handling in that, if they are taken to dryness, one is left with peroxy acid diluted with a significant amount of a surfactant and a highly hydrated salt, which should be safe.

The compositions of the invention are also chemically stable, which is unexpected since a peroxy acid is suspended in a medium containing a high level of organic material.

TYPICAL PREPARATION OF HDL WITH BLEACH

1. Charge vessel with all of free water and LAS (Linear alkyl benzene sulfonate). Heat mixture to 100°-105° F. and agitate to dissolve LAS thoroughly.
2. Add Dequest 2010 [(1-hydroxyethylidene) bisphosphonic acid] and agitate.
3. Add fluorescer and disperse.
4. Add Neodol 25-9. This is a primary $C_{12-15}$ alcohol ethoxylate containing an average of 9 EO units per molecule. This is melted at 110° F., and added with agitation.
5. Cool to room temperature, 75°-80° F. This is critical as the DPDA should not be subjected to high process temperatures.
6. Add DPDA slurry (~25% active) or DPDA wet cake isolated by filtering of a slurry (~40-50% active). The former is more convenient as it is easily pourable.
7. Add perfume.
8. Add premix prepared by dissolving all the borax and $Na_2SO_4$ in the sorbitol. A thickening of the liquid is observed due to structuring induced by the electrolytes.
9. Add polyacrylate.
10. Add decoupling polymer.
11. Add dye.

The finished product is an opaque, creamy liquid with a pH of 4.2-4.4. The final viscosity tends to vary from batch to batch but is generally on the order of 2000-5000 cp when measured on an RV viscometer, RV#3 spindle at 20 rpm. Variability in the viscosity has been observed in different batches of the same formula.

The following examples are designed to illustrate, but not to limit, the practice of the instant invention. Unless otherwise indicated, all percentages are by weight.

EXAMPLE 1

A typical formulation prepared as above is as follows:

| INGREDIENT | ACTIVE WT % | FUNCTION |
|---|---|---|
| (DPDA) | 2.0 | BLEACH |
| $C_{12}$ linear alkyl benzene sulfonate | 16.1 | ANIONIC SURFACTANT |
| NEODOL 25-9 | 6.9 | NONIONIC SURFACTANT |
| Na BORATE DECAHY-DRATE (BORAX) | 5.0 | "pH JUMP" COMPONENT + ALKALINITY SOURCE |
| SORBITOL | 20.0 | "pH JUMP" COMPONENT |
| $NA_2SO_4$ | 0-5.0 | THINNING ELECTROLYTE |
| Na POLY-ACRYLATE MW 10,000 | 0-.20 | THINNING POLYMER |
| COPOLYMER | .5-1.0 | DECOUPLING AGENT |
| DEQUEST 2010 | .30 | METAL ION SEQUESTERANT |
| OPTIMAL INGREDIENT | .49 | PIGMENT, FLOURESCER. PERFUME, ETC. |
| WATER | BALANCE | — |

[1](25:1 molar acrylic acid:lauryl methacrylate copolymer with a MW of 3800)

The inherent pH of this formula without any pH adjustments is 4.0-4.5, optimum for DPDA stability. Typical pH's for the inventive composition on dilution in the wash are 7.0–8.0, which is comparable to, or higher than the wash pH's obtained from many currently marketed HEAVY DUTY LIQUIDS (HDLs). In general, if less than 20% sorbitol is used, then additional acid (e.g. $H_2SO_4$) is required to further reduce the pH of the liquid to 4.0–4.5. By introducing acid into the system however, the overall pH jump is reduced by as much as 0.50–1.0 pH unit since the buffer capacity of the borax is reduced.

The formula above was performance tested versus two commercial Liquids on various monitor cloths. Type 1 monitor cloths are soiled with particulate materials. Type 2 cloths are a combination of oily particulate soil. Bleaching Scores are measured with cloths stained with tea. Results are shown in Table 1.

TABLE 1

Performance of HDL Prototypes vs. two Marketed Liquids (120 ppm Ca/Mg hardness, 14 min. wash, 40° C., 2.0 g/l Reflectance Increase (Δ R)

| Monitor Cloth | HDL + 2% DPDA | A | B |
|---|---|---|---|
| 1 | 23 | 17.4 | 18.2 |
| Bleaching Monitor | 4.5 | −4.3 | −1.0 |
| 2 | 11.5 | 15.2 | 11.6 |
| Wash pH | 7.5 | 9.5 | 7.0 |

The results indicate the composition of Example 1 is better than A and B on type 1 cloths containing predominantly clay. Liquid A is higher on type 2 because of its higher pH. Significant bleach benefits are delivered by the inventive composition even at low levels of bleach.

EXAMPLE 2

DPDA Stability

Typical DPDA half-life ($T_{\frac{1}{2}}$) for the HDL plus bleach prototype is 1½ to 3 months at room temperature with 1–2 weeks at 40° C. Typical DPDA losses as a function of time for samples with and without stabilizing polymer are shown in Table 2. For comparison DPDA incorporated in an alkaline HDL (pH 11.2) has a $T_{\frac{1}{2}}$ of less than one day.

TABLE 2

Chemical Stability of DPDA in prototype HDL + Bleach

| 2.32% DPDA INITIAL (no stabilizing polymer) | | | 1.94% DPDA INITIAL (0.5% stabilizing polymer) | | |
|---|---|---|---|---|---|
| DAYS | % DPDA REMAINING 25° C. | % DPDA REMAINING 40° C. | DAYS | % DPDA REMAINING 25° C. | % DPDA REMAINING 40° C. |
| 0 | 100 | 100 | 0 | 100 | 100 |
| 2 | 100 | 87.2 | 2 | 100 | 87.1 |
| 5 | 100 | 80.6 | 5 | 96.4 | 68.6 |
| 7 | 91.8 | — | 7 | 92.8 | — |
| 9 | — | 51.5 | 9 | — | 50.5 |
| 12 | 85.7 | 22.4 | 12 | 86.6 | 19.1 |
| 14 | 87.2 | 24.0 | 14 | 87.6 | 21.1 |
| 16 | 92.9 | 32.1 | 16 | 87.1 | 27.8 |
| 29 | 80.8 | — | 29 | 76.8 | — |
| 33 | 74.5 | — | 33 | 72.2 | — |
| 40 | 68.4 | — | 40 | 65.5 | — |

EXAMPLE 3

Viscosity Reduction

The viscosity of formulations that do not contain viscosity modifying polymers are typically quite high. By the addition of polymers that do not interact with the lamellar particles, the viscosity can be reduced substantially. This effect is shown in Table 3 where the level of a 10,000 MW polyacrylate is varied in the formulation of Example one. without polymer, the formulation is unacceptably viscous. The addition of less than ½% of polymer reduces viscosity to an acceptable range (less than about 3000 cp).

TABLE 3

Formulation Viscosity as a Function of Polyacrylate Level (mw 10,000)

| Wt % Polyarylate | Viscosity (cp)* |
|---|---|
| 0 | 7600 |
| 0.12 | 5300 |
| 0.20 | 3400 |
| 0.28 | 1700 |
| 0.36 | 1600 |

*Brookfield RV viscometer, spindle #3, 20 rpm (ambient)

EXAMPLE 4

Physical Stability—Stabilizing Polymer

In addition to having an acceptable viscosity, formulations must be physically stable and not separate. Stabilizing (decoupling) polymers prevent the flocculation of the lamellar particles and thereby dramatically improve the physical stability. Two examples of the effect of stabilizing polymers are given in Table 4. Without polymer, these formulations are observed to separate in less than two weeks. With polymer added, both are stable for times in excess of four months.

TABLE 4

Effect of Stabilizing Polymer on Formulation Physical Stability

| | # of Days Until Physical Separation 25° C. | # of Days Until Physical Separation 40° C. |
|---|---|---|
| A. 1.0% Stabilizing polymer .20% polyacrylate | 4 mos. + | 4 mos. + |
| B. 1.0% Stabilizing Polymer 1.0% $Na_2SO_4$ | 4 mos. + | 4 mos. + |
| C. .20% polyacrylate | 12 | 4 |
| D. 1.0% $Na_2SO_4$ | 4 | 4 |

EXAMPLE 5

Alternative Peracids

Table 5 compares the performance of a formulation similar to Example 1 to an identical formulation containing SBPB as the insoluble peracid. Two commercial liquids are included as controls. Bleaching scores as mentioned above for SBPB are lower than those of DPDA but significantly better than controls. On the general detergency monitor cloth (Type 1) mentioned above the SBPB system is again intermediate between DPDA and controls.

TABLE 5

Performance of HDL prototypes vs. Leading Marketed Liquids (120 ppm Ca/Mg hardness, 14 min. wash 40° C., 2 g/l)

| | Δ R Monitor Cloth Type 1 | Δ R Monitor Cloth Bleaching Monitor |
|---|---|---|
| HDL with DPDA | 23.7 | 5.8 |
| HDL with SBPB | 20.1 | 2.1 |
| Liquid A | 17.4 | −4.3 |
| Liquid B | 18.2 | −1.0 |

Table 6 shows the bleach stability of SBPB in a formulation similar to Example one. By comparison to Table 2 SBPB is found to be more stable than DPDA. At 25° C., there is no detectable loss of SBPB in four weeks. Values higher than the initial concentration reflect the inherent scatter in the experimental determination. The increased stability of SBPB is due to the lower solubility in the prototype formulation.

TABLE 6

| SBPB Stability in Prototype Formulation (4.65% SBPB Initial) | | |
|---|---|---|
| | % Peracid Remaining | |
| Time | 25° C. | 40° C. |
| Initial | 100% | 100% |
| 1 Week | 114 | 107 |
| 2 Weeks | 120 | 107 |
| 3 Weeks | 102 | 80 |
| 4 Weeks | 111 | 57 |

DPTA stability is compared to DPTA in Table 7 for a formulation similar to that in Example 1, but without a pH jump system. The formula contains 10% surfactant at pH 4.5. Again, the less soluble peracid (DPTA) is somewhat more stable than DPDA at 40° C. At this surfactant level, both bleaches are stable for up to 49 days at 25° C.

TABLE 7

| Stability of DPDA vs. DPTA in 10% Surfactant Formula (pH 4.5) | | | | |
|---|---|---|---|---|
| | 25° C. | | 40° | |
| Time | DPDA (6.55%) | DPTA (6.77%) | DPDA (6.55%) | DPTA (6.22%) |
| Initial | 100% | 100% | 100% | 100% |
| 19 Days | 99 | 97 | 74 | 86 |
| 33 Days | 98 | 99 | 65 | 83 |
| 49 Days | 98 | 99 | 60 | 74 |

Typical "jumps" are shown in Table 8:

TABLE 8

| pH Jump Profiles in Model Systems | | |
|---|---|---|
| Wt % Borax/Sorbitol/$H_2O$ | pH of Concentrate | pH on 667 × Dilution (1.5 g/l) |
| 1/10/89 | 4.60 | 8.06 |
| 1/20/79 | 4.05 | 7.87 |
| 2/5/93 | 6.13 | 8.30 |
| 2/20/78 | 4.19 | 8.03 |
| 5/10/85 | 6.00 | 8.60 |
| 5/12/83 | 5.58 | 8.35 |
| 5/20/75 | 4.69 | 7.95 |

The effect of addition of calcium and Magnesium salts to the pH jump systems is presented in Table 9. These salts lower the pH of the system.

TABLE 9

| pH Jump Profiles in Model Systems Containing Ca and Mg Salts | | |
|---|---|---|
| | pH of Concentrate | pH on 500 × Dilution (2.0 g/l) |
| Borax/Sorbitol/$CaCl_2.2H_2O/H_2O$ | | |
| 5/10/0/85 | 6.00 | 8.60 |
| 5/10/1/84 | 5.95 | 8.60 |
| 5/10/2/83 | 5.72 | 8.60 |
| 5/10/3/82 | 5.11 | 8.60 |
| 5/10/4/81 | 5.00 | 8.60 |
| 5/10/5/80 | 4.93 | 8.40 |
| Borax/Sorbitol/$MgSO_4/H_2O$ | | |
| 5/10/4/81 | 5.59 | 8.7 |
| 5/10/10/75 | 5.32 | 8.7 |
| 5/10/15/70 | 4.98 | 8.7 |
| 5/10/20/65 | 4.71 | 8.7 |
| 5/10/30/55 | 4.16 | 8.7 |

Other salts may also be used such as $Na_2HPO_4/MgSO_4/H_2O$ and sodium tripolyphosphate (STP). Results are presented in Tables 10 and 11 respectively.

TABLE 10

| pH Jump Profiles for Salt Systems | | |
|---|---|---|
| $Na_2HPO_47H_2O)/MgSO_4/H_2O$ | pH of Concentrate | pH on 500 × Dilution 2.0 g/l |
| 10/0/90 | 8.59 | 8.60 |
| 10/0.5/89.5 | 7.76 | 8.40 |
| 10/2/88 | 6.93 | 8.40 |
| 10/10/80 | 6.05 | 8.39 |
| 10/15/75 | 5.93 | 8.23 |

TABLE 11

| Model pH Jump System Containing STP | |
|---|---|
| Ingredient | Wt % |
| STP | 30% |
| NaCl | 3.9% |
| PEG 400 | 16.3 |
| Neodol 91-6 | 16.7 |
| Water | 33% |
| | pH |
| Concentrate | 6.1 |
| Dilute (100X) | 9.5 |

This invention has been described with respect to certain preferred embodiments and various modifications and variations in the light thereof will be suggested to persons skilled in the art and are to be included within the spirit and purview of this application and the scope of the appended claims.

What is claimed is:

1. A structured aqueous heavy duty liquid cleaning composition concentrate comprising:

(1) about 1 to 40% by weight of the concentrate of a solid, particulate, substantially water-insoluble organic peroxy acid;

(2) about 10 to 50% by weight of the concentrate of a surfactant;

(3) about 1 to 40% by weight of the concentrate of a pH adjusting system which produces a pH in the concentrated composition of about 3–6 and upon dilution of the concentrated composition produces a dilute solution pH of about 7–9;

(4) from 0.1 to 5% of the concentrate of a stability enhancing polymer which is a copolymer of a hydrophilic and a hydrophobic monomer, said hydrophilic monomer being selected from the group consisting of the acid or salt derivatives of maleic anhydride, acrylic acid, methacrylic acid and analogues or acrylic acid where the carboxylate group is replaced by anionic moieties selected from the group consisting of sulfonate, sulfate, phosphonate and mixtures thereof; said hydrophobic monomer being a hydrophilic monomer functionalized with a hydrophobic moiety selected from the group consisting of fatty amides, fatty esters, fatty alkoxylates, $C_{8-22}$ alkyls, alkylaryls and mixtures thereof or a $C_{8-22}$ alkyl or alkylaryl chain formed by reaction with an α olefin.

2. A composition as defined in claim 1 wherein said pH is adjusted by including in said composition an alkaline salt which is insoluble in the concentrated composition and which produces a pH of about 3–6 in the concentrated composition and upon dilution produces a pH of about 7–9 in the dilute solution.

* * * * *

UNITED STATES PATENT AND TRADEMARK OFFICE

CERTIFICATE OF CORRECTION

PATENT NO. : 5,073,285

DATED : December 17, 1991

INVENTOR(S) : Liberati et al.

It is certified that error appears in the above-identified patent and that said Letters Patent is hereby corrected as shown below:

In Claim 1, Column 18, line 44, after the phrase

"dilution of the concentrated composition"

add the phrase:

-- with an amount of water effective for cleaning --

The line should now read as follows:

dilution of the concentrated composition with an amount of water effective for cleaning produces

Signed and Sealed this

Thirteenth Day of April, 1993

*Attest:*

STEPHEN G. KUNIN

*Attesting Officer*

*Acting Commissioner of Patents and Trademarks*